US009711128B2

(12) United States Patent
Gaetje et al.

(10) Patent No.: US 9,711,128 B2
(45) Date of Patent: Jul. 18, 2017

(54) COMBINED AUDIO FOR MULTIPLE CONTENT PRESENTATION

(71) Applicant: OpenTV, Inc., San Francisco, CA (US)

(72) Inventors: Clay E. Gaetje, Fullerton, CA (US); John Tinsman, Fallbrook, CA (US)

(73) Assignee: OpenTV, Inc., San Francisco, CA (US)

( * ) Notice: Subject to any disclaimer, the term of this patent is extended or adjusted under 35 U.S.C. 154(b) by 0 days.

(21) Appl. No.: 14/960,238

(22) Filed: Dec. 4, 2015

(65) Prior Publication Data

US 2017/0162182 A1 Jun. 8, 2017

(51) Int. Cl.
*G10K 11/16* (2006.01)

(52) U.S. Cl.
CPC ..... *G10K 11/16* (2013.01)

(58) Field of Classification Search
CPC ..... G10K 11/16; G10K 11/00; G10K 11/002; G10K 11/178; G10K 11/1782; G10K 2210/1081; H04R 1/10; H04R 1/1008; H04R 1/1083; H04R 3/002; H04R 2420/07
USPC ..... 381/71.6, 71.9, 71.1, 71.4, 71.8, 71.13
See application file for complete search history.

(56) References Cited

U.S. PATENT DOCUMENTS 9,185,506 B1 11/2015 Deng
2006/0262935 A1* 11/2006 Goose ..... H04S 3/002 381/17
2008/0269926 A1 10/2008 Xiang et al.
2011/0157168 A1 6/2011 Bennett et al.
2012/0095749 A1* 4/2012 Capretta ..... H04H 20/63 704/8
2014/0148224 A1 5/2014 Truong et al.
2014/0334627 A1 11/2014 Kulavik et al.
2015/0030165 A1 1/2015 Risberg et al.
2015/0146879 A1* 5/2015 Nguyen ..... H04R 1/1041 381/74
2015/0319518 A1 11/2015 Wilson
2016/0098982 A1* 4/2016 Doshi ..... G10K 11/1788 381/71.6

OTHER PUBLICATIONS

International Application Serial No. PCT/US2016/064545, International Search Report mailed Feb. 17, 2017, 2 pgs.
International Application Serial No. PCT/US2016/064545, Written Opinion mailed Feb. 17, 2017, 6 pgs.

* cited by examiner

*Primary Examiner* — Vivian Chin
*Assistant Examiner* — Jason R Kurr
(74) *Attorney, Agent, or Firm* — Schwegman, Lundberg & Woessner, P.A.

(57) ABSTRACT

In example embodiments, a system and method for presenting a combined audio stream from a single presentation system to a plurality of users is provided. The method comprises receiving an audio filtering signal, the audio filtering signal corresponding to unwanted audio data to be filtered from an ambient audio signal that includes a combined audio stream output from an audio output device of the single presentation system. A device filtering signal is generated based on the audio filtering signal. The device filtering signal is output by an audio device of a user (e.g., headphone). The device filtering signal is played through the audio device to filter out the unwanted audio data while allowing other audio data in the ambient audio signal to be heard by the user.

20 Claims, 7 Drawing Sheets

COMBINED AUDIO FOR MULTIPLE CONTENT PRESENTATION

FIELD

The present disclosure relates generally to content presentation, and in a specific example embodiment, to handling combined audio for multiple contents presented from a same audio output device.

BACKGROUND

In an enclosed environment or area, two individuals may desire to experience different content from a same device, such as a television, monitor, or speakers. Conventionally, it is not possible to use a speaker of the television or monitor to present audio for multiple content being displayed on the same screen of the television or monitor.

BRIEF DESCRIPTION OF DRAWINGS

Various ones of the appended drawings merely illustrate example embodiments of the present invention and cannot be considered as limiting its scope.

DETAILED DESCRIPTION

Figure 1:
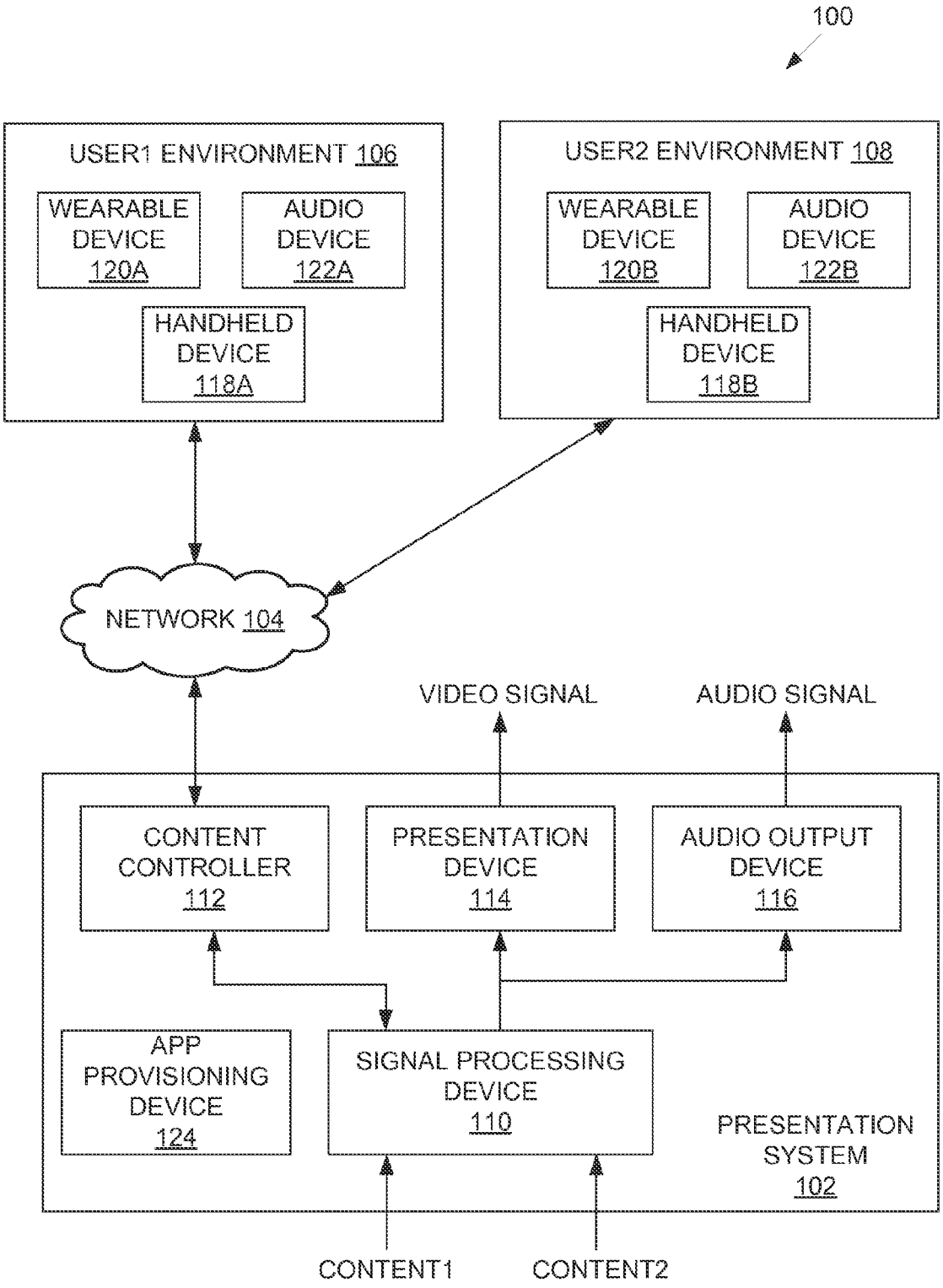
FIG. 1 is a diagram illustrating an example environment in which embodiments of a system may be implemented.

The description that follows includes systems, methods, techniques, instruction sequences, and computing machine program products that embody illustrative embodiments of the present inventive subject matter. In the following description, for purposes of explanation, numerous specific details are set forth in order to provide an understanding of various embodiments of the inventive subject matter. It will be evident, however, to those skilled in the art that embodiments of the inventive subject matter may be practiced without some or other of these specific details. In general, well-known instruction instances, protocols, structures, and techniques have not been shown in detail.

Example embodiments described herein provide systems and methods for presenting multiple programs or content including a combined audio stream from a same audio output device. The content can comprise programs (e.g., television show, videos, movies, music, and concerts), a blank presentation, or computing device outputs (e.g., audio from an application running on a computing device). The combined audio stream combines a first audio track from a first content stream and a second audio track from a second content stream. The first audio track is to be heard by a first user using a first audio device while the second audio track is to be heard by a second viewer using a second audio device. Because an ambient audio signal heard by a user includes the first and second audio tracks from the multiple content, the ambient audio signal will likely sound like gibberish. Accordingly, each user is provided with a respective audio device, such as a headphone, that filters out unwanted audio (e.g., audio track of the content that the user is not experiencing).

Conventional noise canceling headphones isolate desired sound by analyzing ambient noise, creating an inverse (canceling) sound wave for the ambient noise, and combining the inverse sound wave with a signal for the desired sound. The inverse sound wave effectively cancels out the ambient noise, leaving only the desired sound.

In contrast, the audio device (e.g., headphone) or the audio filtering system associated with the audio device, in example embodiments, are not configured to dynamically analyze the ambient noise and create an inverse sound wave of the ambient noise. Instead, an inverse sound wave corresponding to audio data (e.g., an audio track) of another user's content (e.g., unwanted audio content) is generated and used to filter out the unwanted audio data from the ambient audio signal. The ambient audio signal comprises an audio signal (e.g., the combined audio tracks or streams) from an audio output device of a presentation system (e.g., speakers of a television) along with any environmental noises (e.g., conversation with another person, phone ringing, doorbell chime). In various embodiments, the inverse sound wave may be provided to the headphone (e.g., wirelessly or through a wired connection) from a handheld device associated with each user, or may be generated by the headphone, itself.

In some embodiments, a reference audio signal is used to assist in the suppression of the unwanted audio. The reference signal may be constructed to be imperceptible in the presence of the user's content, or it may be constructed to easily be filtered to an inaudible level. Because audio signals decrease over distance, the reference signal is used to modify a level of the inverse sound wave so as not to overcorrect and degrade wanted sound or undercorrect for the unwanted sounds, and to assist with estimating environmental effects upon the unwanted audio, such as reflections and absorption, which may be frequency dependent. In a presentation system that comprises multiple speakers, a different reference signal can be provided from each speaker to account for a three-dimensional movement of the user within an environment.

As a result, one or more of the methodologies described herein facilitate solving the technical problems relating to presenting multiple contents from a same presentation system whereby a combined audio signal is outputted. As a result, one or more of the methodologies described herein may obviate a need for certain efforts or resources that otherwise would be involved in having to present the audio from two or more separate audio output devices. Additionally, resources used by one or more machines, databases, or devices (e.g., within the network environment) may be reduced. Examples of such computing resources include processor cycles, network traffic, memory usage, data storage capacity, power consumption, network bandwidth, and cooling capacity.

With reference to FIG. 1, a diagram illustrating an example environment 100 in which embodiments of a system for providing multiple visual content from a same presentation device and a combined audio signal for the multiple content from a same audio output device is provided. The environment 100 includes an area in which multiple users are present (e.g., a bedroom, living room, or office). The environment 100 comprises a presentation system 102 coupled via a network 104 (e.g., the Internet, wireless network, cellular network, PSTN, Bluetooth, infrared, or a Wide Area Network (WAN)) to a plurality of user environments (e.g., user1 environment 106 and user2 environment 108). The user1 environment 106 is associated with a first user, while the user2 environment 108 is associated with a second user. In example embodiments, the first and second users each desire to experience a different program or content. In one instance, the first user desires to experience a program, and the second user desires to not hear audio from the program being experienced from the first user (e.g., block out the audio from the program of the first user).

The presentation system 102 is configured to receive content from various sources and generate a combined video stream, if applicable, and a combined audio stream that are presented to the first and second users. As such, a combine video stream comprises combined video data (e.g., frames, pixels) from the various sources. Similarly, a combined audio signal comprises combined audio data or audio tracks from the various sources. Accordingly, the presentation system 102 comprises a signal processing device 110, a content controller 112, a presentation device 114, and an audio output device 116 (e.g., speakers or speaker system). In some embodiments, some components of the presentation system 102 may be embodied within other components. For example, the signal processing device 110, audio output device 116, or the content controller may be a part of the presentation device 114 (e.g., a television). In another example, the content controller 112 may be a part of the signal processing device 110.

The signal processing device 110 is configured to receive multiple content streams and to combine the content streams to generate a combined video stream (also referred to as a "combined video signal") and a combined audio stream (also referred to as a "combined audio signal") that together presents the combined content or programs. In one embodiment, a single combined stream or signal that combines both video data and audio data from the multiple content sources is generated. The combined video stream and combined audio stream are then provided to the presentation device 114 (e.g., a television, monitor) for video presentation to the users and to the audio output device 116 (e.g., speakers, stereo speaker system) for audio presentation to the users. In an alternative embodiment, the individual audio streams (e.g., audio tracks) for the multiple content may be provided to the audio output device 116, and the audio output device 116 simply plays the individual audio data simultaneously effectively resulting in a combined audio stream. The signal processing device 110 will be discussed in more detail in connection with FIG. 2 below.

The content controller 112 is configured to receive and process control signals from a handheld device (e.g., handheld device 118A or 118B; collectively referred to as "handheld device 118") at the user environment 106 or 108. The control signal indicates an action to be performed with respect to one of the contents or programs being presented to the users. For example, the first user at the user1 environment 106 desires to pause program1, and provides an indication of this desire using their handheld device 118A. The content controller 112 receives this indication and causes the signal processing device 110 to adjust or modify the combining such that program1 is paused while program2 being experienced by the second user is unaffected (e.g., continues playing for the second user). Any operations that can be performed on a program or content may be indicated via the control signal such as, for example, pausing, rewinding, forwarding, stopping, changing content, or exiting from experiencing the content and, for example, viewing a guide or interacting with a user interface. It is noted that program1 and program2 may be the same program. However, because each user can control their own experience, the actual presentation of the same program may be different for each user. Additionally, white embodiments discuss content having both a video component and an audio component, alternatively, content having only an audio component may be combined and presented to the users.

The handheld device 118 comprises an application that specially configures the handheld device 118 to operate as a control device or remote control for controlling the content or program that the respective user is experiencing. The application may be downloaded or otherwise obtained from an application provisioning device 124. While the application provisioning device 124 is shown to be within the presentation system 102, alternatively, the application provisioning device 124 may be located outside of the presentation system 102 but accessible via the network 104.

In an alternative embodiment, the audio output device 116 is coupled to the network 104 and provides the appropriate audio track to the handheld device 118 of each user. For example, audio for program1 is provided via the network 104 to the handheld device 118A of the first viewer, while audio for program2 is provided via the network 104 to the handheld device 118B of the second viewer. The respective viewers can then listen to their audio (e.g., simulcast) through a coupled audio device 122A or 122B (also referred to as audio device 122), such as a headset.

Alternatively, the audio may be provided directly from the audio output device 116 to the respective audio device 122 of each user. For example, the audio output device 116 or the presentation device 114 (e.g., in the case of a television) can wirelessly transmit the appropriate audio track to each respective audio device 122.

Each user environment 106 and 108 comprises the handheld device 118A or 118B, a wearable device 120A or 120B (also referred to as wearable device 120), and the audio device 122A or 122B. The handheld device 118 will be discussed in more detail in connection with FIGS. 3 and 4.

The wearable device 120 comprises eyewear or glasses that are similar in application to 3D glasses. In example embodiments, the combined video stream being displayed by the presentation device 114 comprises frames of a first video content of a first content stream and a second video content of a second content stream that are interleaved. Thus, for example, odd-numbered frames of the combined video stream are from program1 and even-numbered flumes are from program2. Accordingly, instead of having a left lens and a right lens, as is typical in 3D glasses, the wearable device 120A comprises two "right" lenses, while the wearable device 120B comprises two "left" lenses. The "right" lenses allow viewing, for example, of the odd-numbered frames, while the "left" lenses allow viewing of the even-numbered frames from the combined video stream that is displayed on the presentation device 114 (or vice-versa). This, for example, allows the first user with the wearable device 120A to see the odd-numbered frames that represent program1 and not see the even-numbered frames that represent program2. Conversely, the second user having the wearable device 120B with two "left" lenses will see the even-numbered frames that represent program2, but not see the odd-numbered frames that represent program1.

In an alternative embodiment, the combined video stream comprises frames containing pixels polarized in a first direction from program1 and pixels polarized in a second direction from program2, whereby polarization in the second direction is orthogonal to the first direction. For example, the pixels from program1 can be vertically polarized while the pixels from program2 can be horizontally polarized. Accordingly, the "right" lenses comprises a first direction polarizer (e.g., vertical polarizer) that allows viewing of pixels polarized in the first direction, while the "left" lenses comprises a second direction polarizer (e.g., horizontal polarizer) that allows viewing of pixels polarized in the second direction. This, for example, enables the first user with the wearable device 120A to see the vertical polarization that represents program1 and not see the horizontal polarization that represents program2. Conversely, the second user having the wearable device 120B with two "left" lenses will see the horizontal polarization that represents program2, but not see the vertical polarization that represents program1.

In example embodiments, the audio output device 116 presents a combined audio signal that combines audio data from the multiple content. As such, the users would hear gibberish if the users were to listen to the output (e.g., ambient audio signal) of the audio output device 116. To remedy this situation, the audio device 122A is provided with an audio filter signal that represents the audio track or signal for program2. Using this audio fitter signal, the audio device 122A filters out (e.g., blocks out) the audio signal for program2. As a result, the first user wearing the audio device 122A hears the audio for program1 along with any environmental noise (e.g., telephone ring, doorbell, conversation with another individual). In one embodiment, the audio filter signal comprises an inverse sound wave for the audio signal to be filtered out (e.g., audio signal for program2). The audio device 122 will be discussed in more detail in connection with FIG. 4.

In an alternative embodiment, the audio output device 116 is coupled to the network 104 and provides audio for a specific program to the handheld device 118 of the user. For example, an audio track for program1 is provided via the network 104 to the handheld device 118A of the first user, while an audio track for program2 is provided via the network 104 to the handheld device 118B of the second user. The respective users can then receive the audio track (e.g., simulcast) through a coupled audio device 122A or 122B (e.g., via a wired or wireless connection between the handheld device 118 and the audio device 122). Alternatively, the audio may be provided directly from the audio output device 116 to each of the respective audio device 122. For example, the audio output device 116 or the presentation device 114 can wirelessly transmit the proper audio track to the respective audio device 122.

It is noted that the environment 100 shown in FIG. 1 is merely an example. For example, alternative embodiments may comprise any number of user environments 106 and 108. Furthermore, any number of content signals may be received and combined by the signal processing device 110.

Figure 2:
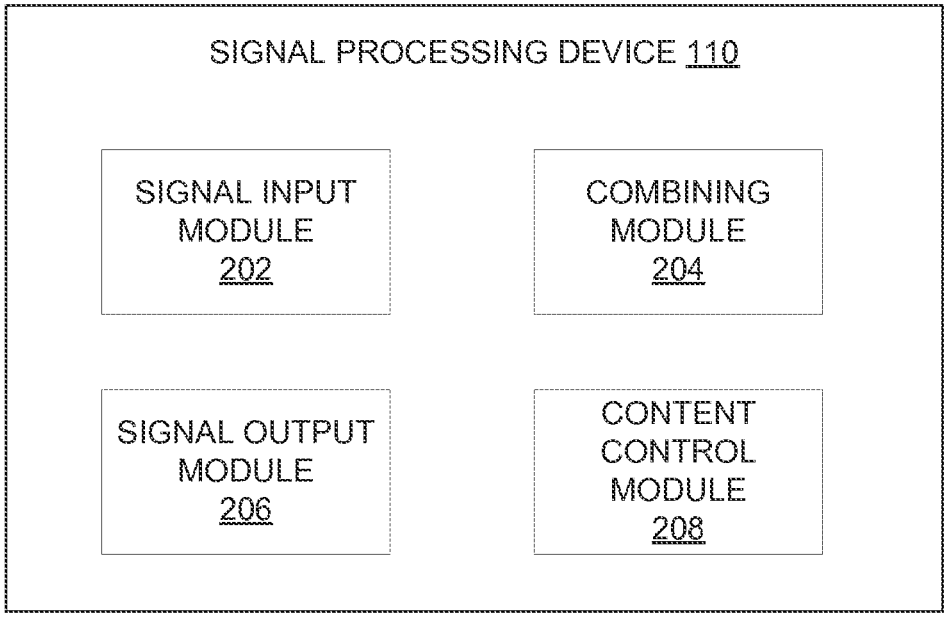
FIG. 2 is a block diagram illustrating an example embodiment of a signal processing device.

FIG. 2 is a block diagram illustrating an example embodiment of the signal processing device 110. The signal processing device 110 is configured to receive multiple content streams each representing a particular piece of content or a program (e.g., television show, movie, music track) and to combine the content streams to generate a combined stream that contains two or more content (e.g., program1 and program2). The combined stream may comprise a combined video stream, a combined audio stream (also referred to as combined audio signal), or a combination of both video and audio streams. In one embodiment, one of the content comprises computer outputs (e.g., user interfaces and accompanying audio resulting from an application running on a computer or webpage or streaming content including music from the Internet). Thus, for example, a first user may watch a DVD while a second user streams content from the Internet. In another example, both users may be streaming content from different applications or websites.

To enable the operations of the signal processing device 110, the signal processing device 110 comprises a signal input module 202, a combining module 204, a signal output module 206, and a content control module 208 all communicatively coupled together (e.g., via a bus). The signal processing device 110 may comprise other components not pertinent to example embodiments that are not shown or discussed. Furthermore, alternative embodiments may comprise more, less, multiples of, or other modules, or locate the modules in other components of the presentation system 102. Additionally, some functions of the modules may be combined or divided into two or more further modules.

The signal input module 202 is configured to receive the individual content streams from various sources. For example, the sources of the content streams may include broadcast video, cable, satellite, Internet Protocol television (IPTV), over-the-top content (OTT), DVR recordings, computer display, Internet streaming, or any content stream that can be received through any standard inputs to, for example, a television display. The content streams are then passed to the combining module 204.

The combining module 204 is configured to generate the combined audio stream (or cause the generation of the combined audio stream) that is presented to the multiple users. With respect to the audio, the combining module 204 combines the audio data or audio tracks from the multiple content streams into a single combined audio stream. In one embodiment, the combining module 204 incorporates a reference signal into the combined audio stream. The reference signal is used by an audio filtering system located at the user environment 106 or 108 to adjust a level of a device filtering signal (e.g., an inverse sound wave for the unwanted audio) as will be discussed in more detail below.

The signal output module 206 is configured to provide the combined audio stream for presentation. Thus, the signal output module 206 provides the combined audio stream to the audio output device 116 (e.g., speakers), which in turn plays the combined audio stream. In an alternative embodiment, the audio data or track for each content may be individually provided to the audio output device 116 and is simultaneously played by the audio output device 116. In this case, the reference signal may also be provided by, for example, the combining module 204 and combined with the audio tracks for output at the audio output device 116.

The content control module 208 is configured to work with the content controller 112 to cause actions to occur with respect to the content being presented. For example, the first user at the user1 environment 106 desires to change program1 to a program3 and provides an indication of this desire using their handheld device 118A. The content controller 112 receives this indication (via a control signal) and provides this indication to the content control module 208. The content control module 208 than provides instructions to, or otherwise causes, the combining module 204 to adjust or modify the combined audio stream (and the combined video stream if applicable) such that program1 is replaced with program 3 for the first user, while program2 being experienced by the second user is unaffected (e.g., continues playing for the second user). Similar operations may be performed for other actions to be performed to the program such as pause, rewind, forward, stop, or exiting the program to interact with a user interface. In some embodiments, the functionality of the content control module 208 may be incorporated into the combining module 204.

Figure 3:
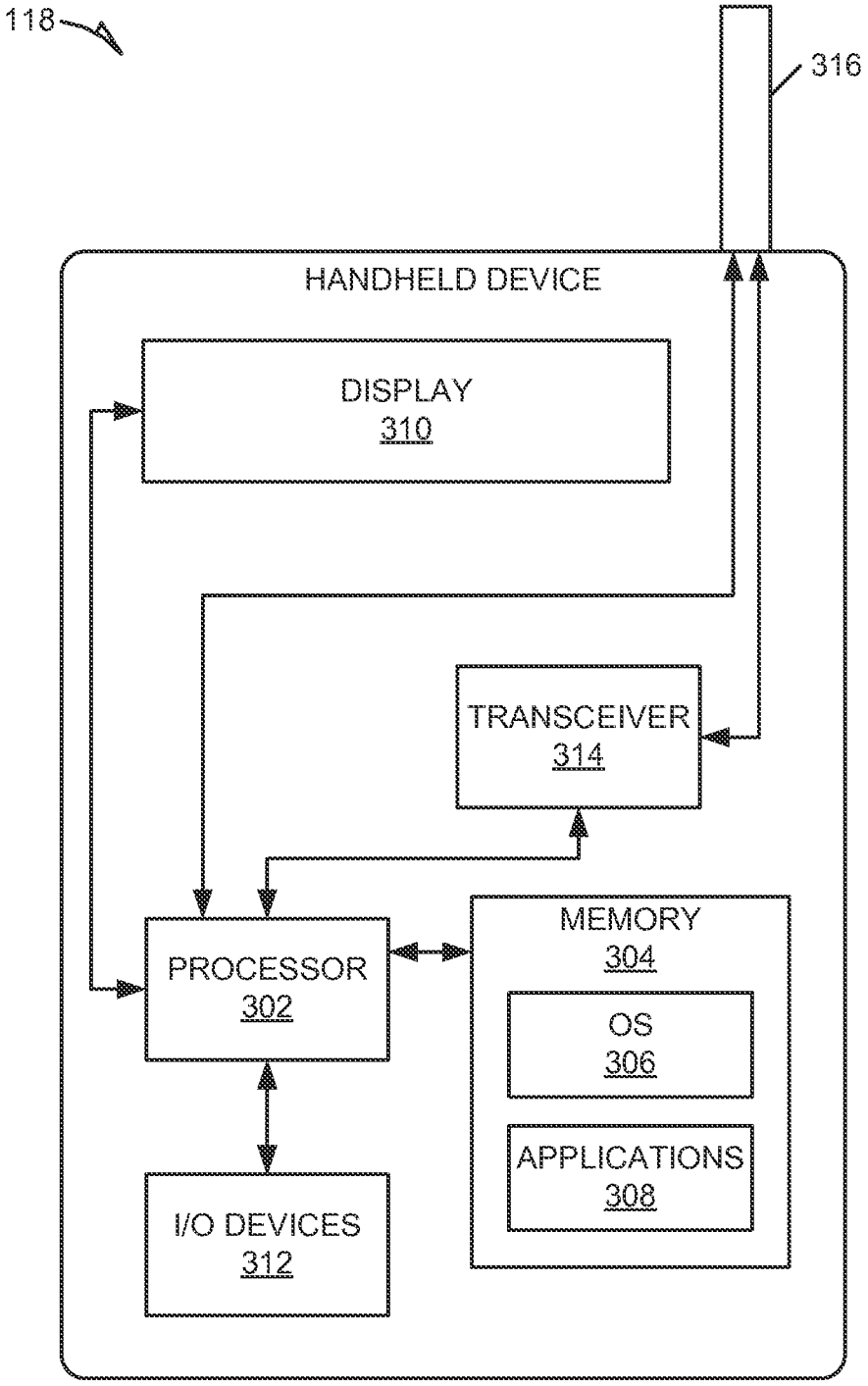
FIG. 3 is a block diagram illustrating an example embodiment of a handheld device.

Referring now to FIG. 3, a detailed block diagram illustrating an example embodiment of the handheld device 118 is shown. The handheld device 118 may comprise a mobile device such as, for example, a mobile phone, a tablet, or a remote control. The handheld device 118 includes a processor 302. The processor 302 may be any of a variety of different types of commercially available processors suitable for mobile devices (e.g., an XScale architecture microprocessor, a Microprocessor without Interlocked Pipeline Stages (MIS) architecture processor, or another type of processor). A memory 304, such as a Random Access Memory (RAM), a Flash memory, or other type of memory, is typically accessible to the processor 302. The memory 304 is adapted to store an operating system (OS) 306, as well as applications 308, such as a content application that allows a user using the handheld device 118 to control the program or content the user is experiencing. The processor 302 may be coupled, either directly or via appropriate intermediary hardware, to a display 310 and to one or more input/output (I/O) devices 312, such as a keypad, a touch panel sensor, a microphone, and the like. Similarly, in some embodiments, the processor 302 may be coupled to a transceiver 314 that interfaces with an antenna 316. The transceiver 314 is configured to both transmit and receive network signals, wireless data signals, or other types of signals via the antenna 316 or other sensors (e.g., infrared sensor) available on the handheld device 118, depending on the nature of the handheld device 118.

In example embodiments, the handheld device 118 is registered or otherwise known to the presentation system 102. For example, the handheld device 118 may be registered with the content controller 112 or the signal processing device 110. Based on the registration, the presentation system 102 knows which program is being presented to each of the user environments 106 or 108. As a result, for example, appropriate audio filtering signals corresponding to or representing the audio signal, stream, or track that is to be filtered out can be transmitted to the proper handheld device 118. In another example, control signals received from the handheld device 118 can indicate the program being experienced by the corresponding user.

Figure 4:
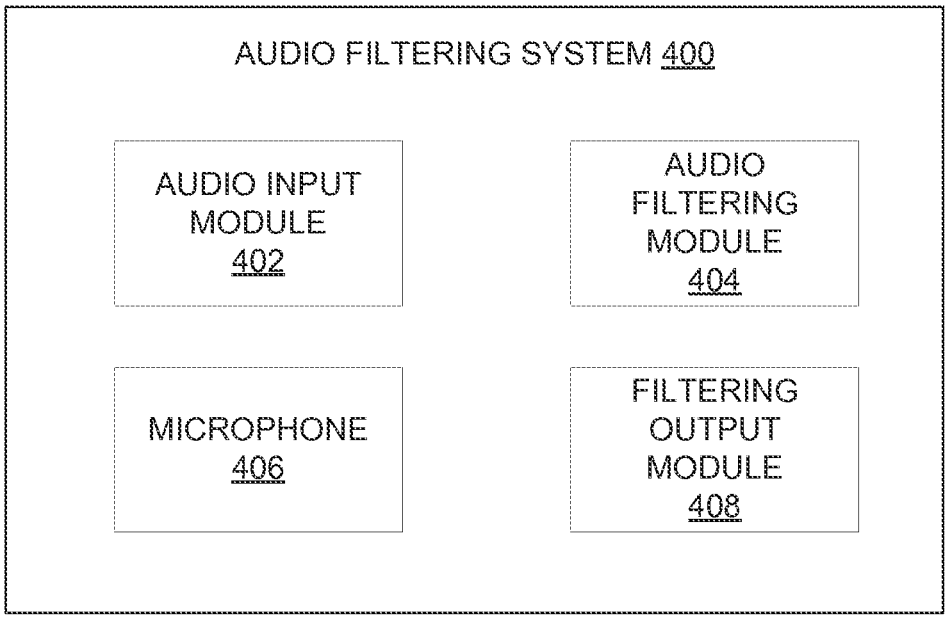
FIG. 4 is a block diagram illustrating an example embodiment of an audio filtering system.

Referring now to FIG. 4, an audio filtering system 400 is shown. In example embodiments, the audio filtering system 400 is embodied within the handheld device 118 (e.g., with some components being a part of, or using functionalities of, the content application provisioned by the application provisioning device 124). In this embodiment, the handheld device 118 generates a device filter signal which is provided to the coupled audio device 122. The device filter signal is an inverse sound wave of the unwanted audio (received as the audio filtering signal) that filters out or blocks the unwanted audio (e.g., the other user's program or content). In some embodiments, a level of the inverse sound wave is adjusted based on an estimated distance and orientation of the user from the audio source (e.g., the audio output device 116). In another embodiment, the audio filtering system 400 is embodied within the audio device 122, itself, and the audio device 122 generates the device filter signal and uses it to filter out the unwanted audio. As such, the audio filtering system 400 generates the device filtering signal. In order to enable this operation, the audio filtering system 400 comprises an audio input module 402, an audio filtering module 404, a microphone 406, and a filtering output module 108.

The audio input module 402 is configured to receive an audio filter signal that represents (or corresponds to) the unwanted audio. In one embodiment, the audio filter signal may be an audio track or stream for the content that the user wants to filter out (e.g., audio track of the other user's content). The audio filter signal is then used to generate the device filter signal (e.g., an inverse sound wave of the unwanted audio adjusted for user distance and orientation from the audio source) that is used to filter out the unwanted audio that is presented as a part of the combined audio stream from the audio output device 116. In an alternative embodiment, the audio filter signal may be the inverse sound wave of the unwanted audio or the device filter signal, whereby the presentation system 102 (e.g., the signal processing device 110) generates the inverse sound wave or the device filter signal and transmits it to the appropriate handheld device 118 or audio device 122, for example, via the network 104.

In some embodiments, the audio input module 402 also receives or detects a reference signal. In normal noise canceling operations, a location of the user is irrelevant because a microphone picks up whatever unwanted noise is reaching the user's ears wherever the user is at, and cancels that unwanted noise out. In example embodiments, because the audio filtering system 400 is canceling out a specific audio signal (e.g., the unwanted audio stream or data from the other content) and allowing other audio including audio for the content the user is experiencing to be heard, it is important to know where the user is in relations to the reference signal and the source of the combined audio stream (e.g., the audio output device 116). For instance, if the first user walks up close to the audio output device 116, a louder audio signal needs to be filtered out versus if the first user is further away. Similarly, if the first user moves left or right, the audio received from the audio output device 116 changes. Accordingly, the reference signal provides a mechanism to help estimate an effect of the listening environment and a relative position of the unwanted audio source and the listener. The reference signal may be transmitted by the presentation system 102 (e.g., by the audio output device 116), for example, as part of the combined audio stream. Alternatively, the reference signal may be presented by devices in the environment 100 so long as the device is located substantially near the audio output device 116.

In some embodiments, a plurality of reference signals are provided, corresponding to a plurality of speakers associated with the audio output device. The plurality of reference signals may be provided in parallel or to a subset of the output speakers at any given time. These reference signals are used to help estimate an amplitude of any arriving unwanted signal, as well as impact or effect of the listening environment on the unwanted signal as it travels from a speaker associated with the audio output device 116 to the user. These effects include filtering and attenuation, as well as reflections or echoes. This estimate may be used in conjunction with the audio fitter signal to generate the device filter signal. If the user's audio device has more than one output, such as stereo headphones, one device filter signal may be generated for each such output.

In one embodiment, the unwanted audio itself can be used as the reference signal. Since the audio filter signal (corresponding to the unwanted audio track) is already provided to the audio filtering system 400, the audio filtering module 404 knows what the audio filtering signal should look like (e.g., waveforms). One embodiment is based on correlating the external sound arriving at the signal input module 202 with the audio filter signal, and using that correlation to estimate the filter characteristics required to generate a device filter signal that substantially cancels the unwanted audio sound. In another embodiment, analysis of the spectrum of the audio filter signal and the sound arriving at the signal input module 202 are used to generate the device filter signal.

The audio filtering module 404 is configured to generate the device fitter signal using the audio filter signal alone or in combination with the reference signal. The generating of the device filter signal is adaptive. That is, the audio filtering module 404 will constantly adjust to changes in the environment 100 (e.g., the user turning their head when the audio filtering system 400 is a part of the audio device 122 that the user is wearing). The device filter signal is used to filter out the unwanted audio for the content that the user is not experiencing. For example, the device filter signal filters out an audio track from program2 for the first user that is experiencing program1. In example embodiments, the device filter signal does not filter out any ambient noise. As such, ambient noises such as, for example, a telephone ring, doorbell, or conversation with another individual can be heard through the audio device 122.

In some embodiments, the microphone 406 detects the reference signal and provides the reference signal to the audio filtering module 404. In embodiments where the audio filtering system 400 is embodied in the handheld device 118, the microphone 406 may be a standard component of the handheld device 118 or the audio device 122 which captures the reference signal and provides the reference signal to the audio filtering module 404. In embodiments where the audio filtering system 400 is embodied in the audio device 122, the microphone 406 is provided on the audio device 122. As such, the audio filtering system 400 may be at either the handheld device 118 or the audio device 122.

In some embodiments, the reference signal at the audio output device 116 may comprise an imperceptible multi-frequency signal. Such a reference signal can be constructed taking into account the spectral content of the desired audio signal so as to be masked by the wanted or unwanted audio signal as perceived by the listener. Accordingly, the reference signal can be added to the combined audio stream and be a part of the combined audio stream. The microphone 406 picks up the reference signal, and analyzes the received signal at the known frequencies in the reference signal. Based on this analysis, the audio filtering module 404 estimates the environmental characteristics (e.g., effect of the audio environment) to assist in the construction of the inverse filter signal for the unwanted audio. In example embodiments, the reference signal may comprise a steady signal or one that is pulsed. For example, a pulsed multi-frequency reference signal can be processed to estimate frequency dependent reflections and absorptions in the environment.

The filtering output module 408 is configured to output the device filter signal. In embodiments where the audio filtering system 400 is embodied in the handheld device 118, the filtering output module 406 transmits the device filter signal to the audio device 122 (e.g., via wired or wireless connection). Alternatively, in embodiments where the filtering output module 4085 is embodied within the audio device 122, the filtering output module 408 provides the device filter signal to an audio output component (e.g., earphones) of the audio device 122 which presents the device filter signal to each ear of the user.

Figure 5:
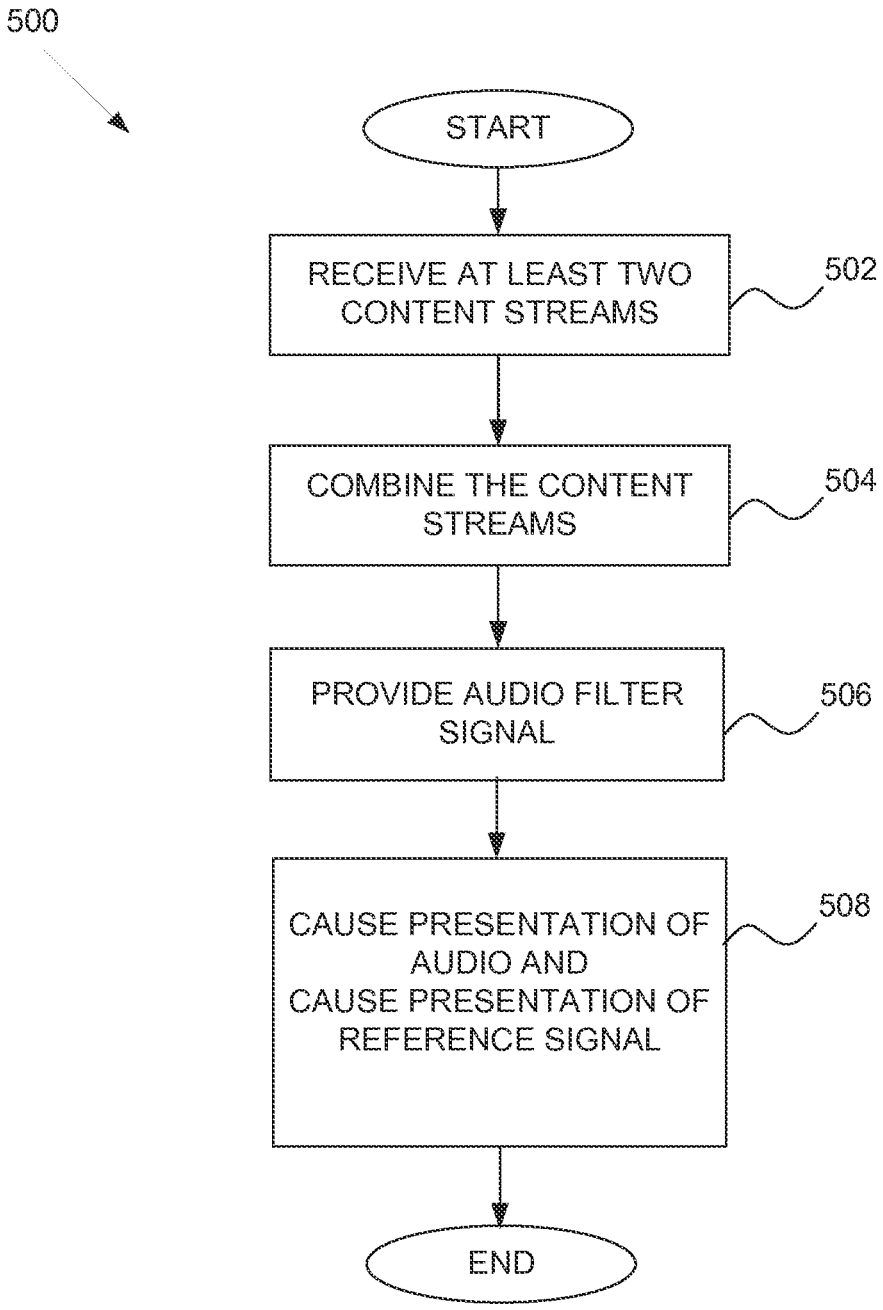
FIG. 5 is a flow diagram of an example method for managing audio and reference signals at a presentation system.

FIG. 5 is a flow diagram of an example method 500 for managing audio signals and reference signals at the presentation system 102. The method 500 may be embodied in computer-readable instructions for execution by one or more processors such that the operations of the method 500 may be performed in part or in whole by the presentation system 102. Accordingly, the method 500 is described by way of example with reference to the presentation system 102. However, it shall be appreciated that at least some of the operations of the method 500 may be deployed on various other hardware configurations and the method 500 is not intended to be limited to the presentation system 102.

In operation 502, at least two content streams are received by the signal processing device 110. The content streams represent programs or content that each individual user of a plurality of users has selected for playing (e.g., via their handheld device 118) and can include audio data (e.g., audio track) or a combination of both video and audio data. The content streams may be received from sources such as, for example, broadcast video, cable, satellite, Internet Protocol television (IPTV), over-the-top content (OTT), and DVR recordings.

In operation 504, the audio component (e.g., tracks or data) of the content streams are combined (or caused to be combined) into a single combined audio stream. In one embodiment, the signal processing device 110 combines the audio data from the content stream to generate the combined audio stream. In an alternative embodiment, the signal processing device 110 provides the audio data from each content stream to the audio output device 116, which then plays the audio data together. In an embodiment where a first user wants to listen to audio data and a second user wants to block out the audio data, only a single content signal is received in operation 502 and operation 504 is not needed.

In operation 506, an audio filter signal is provided to each respective audio filtering system 400 in each user environment 106. In example embodiments, the signal output module 206 provides the audio filter signal to each respective audio filtering system 400. The audio filtering signal represents or corresponds to the unwanted audio data that is to be filtered from the combined audio stream. Since the signal input module 202 of the signal processing device 110 receives the content streams, the signal processing device 110 knows which user environment 106, and thus which audio filtering system 400 of each user environment 106, should receive each respective audio filter signal. For example, an audio filter signal that corresponds to an audio track for program2 (being presented to the second user) is provided to the audio filtering system 400 of the first user. Similarly, an audio filter signal that corresponds to an audio track for program1 (being presented to the first user) is provided to the audio filtering system 400 of the second user. The audio filter signal may be provided via, for example, wireless transmission over the network 104.

In operation 508, the combined audio stream is presented to the users. Accordingly, the signal processing device 110 provides the combined audio stream to the audio output device 116 (or the audio data from each content stream). Additionally, if there is a combined video stream, the combined video stream is provided to the presentation device 114. The audio output device 116 and optional presentation device 114 causes output of the combined stream(s).

In operation 508, the reference signal is also caused to be presented. In some embodiments, the reference signal can be combined into the combined audio stream as part of operation 504. Alternatively, the reference signal may be separately provided and played simultaneously with the combined audio stream by the audio output device 116.

Figure 6:
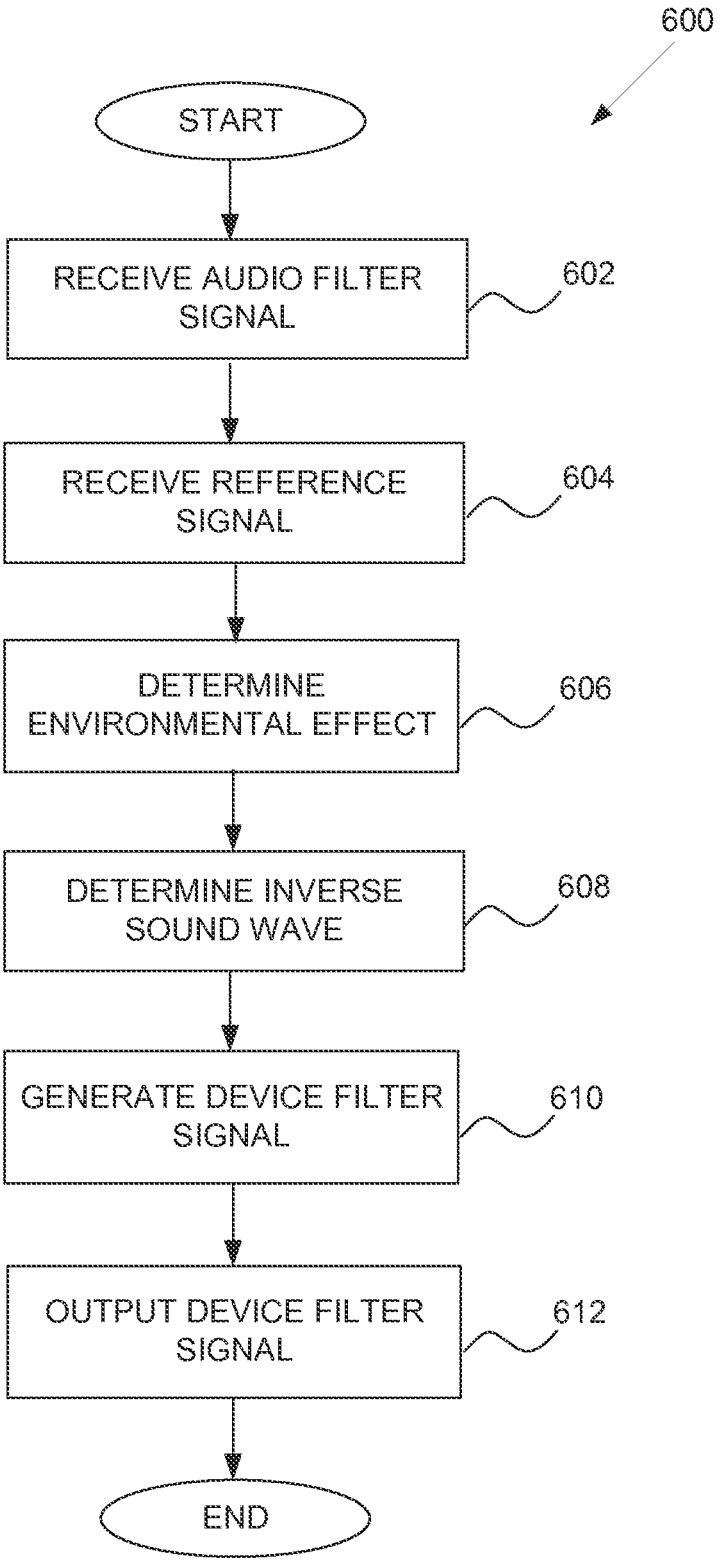
FIG. 6 is a flow diagram of an example method fir filtering out unwanted audio from a multiplexed audio signal at a user environment.

FIG. 6 is a flow diagram of an example method 600 for filtering out unwanted audio from a combined audio stream received at a user environment 106. The method 600 may be embodied in computer-readable instructions for execution by one or more processors such that the operations of the method 600 may be performed in part or in whole by the audio filtering system 400. Accordingly, the method 600 is described by way of example with reference to the audio filtering system 400. However, it shall be appreciated that at least some of the operations of the method 600 may be deployed on various other hardware configurations and the method 600 is not intended to be limited to the audio filtering system 400.

In operation 602, an audio filter signal corresponding to the unwanted audio to be filtered out is received by the audio input module 402. In operation 604, a reference signal is received by the audio input module 402. In example embodiments, the reference signal may comprise a reference tone sent at a specific frequency, fixed output level from the audio output device 116. Alternatively, the reference signal may be an inaudible pilot tone or tones, or a multi-frequency pulse. In another embodiment, the unwanted audio can be used as the reference signal.

In operations 606 one or more environment effects are determined. The unwanted audio arriving at the user may contain a direct component, a component that is partially absorbed, and/or a reflected components. These components are not generally simple copies of the original unwanted audio, but have also been distorted in transmission, and spectrally altered and attenuated by the various materials in the paths between the unwanted audio source and a user's ear. The environment may also contain resonances, which accentuate particular frequencies. Collectively, these environmental effects distort the original unwanted audio sound waves before their perception by the user.

The generation of an inverse sound wave requires that the known original unwanted audio signal be similarly distorted to achieve proper cancellation. This distortion is determined by comparing an original known signal, such as the unwanted audio or reference signal, to the corresponding received signal, and then modeling the environmental effects using conventional techniques such as deconvolution and/or a pole/zero system. Intrinsic model information, such as estimates of the transfer functions of the microphone 406, the audio output module 408, or the acoustic coupling between the left and right ear of the user may also be incorporated into determination of the inverse sound wave. In one embodiment, the inverse sound wave is individually determined for each ear.

Using the audio filter signal and the environmental effects determined in operation 606, an inverse sound wave is determined in operation 608. In one embodiment, the audio filter signal may be an audio track for the content that the user wants to filter out (e.g., audio track of the other user's content). In this embodiment, the audio filtering module 404 generates a sound wave that is an inverse of the unwanted audio track taking into consideration the environmental effects. In an alternative embodiment, the audio filter signal may be, itself, the inverse sound wave of the audio data that is to be filtered out that is adjusted by the environmental effects.

In operation 610, a device filter signal is generated. In example embodiments, the audio filtering module 404 adjusts a level of the inverse sound wave based on the determined environmental effect to derive the device filter signal. Because the audio filtering module 404 is attempting to filter out specific audio, the audio filtering module 404 wants to filter out an exact decibel of the frequency of the unwanted audio. As such the environmental effect is important in order to filter out the unwanted audio that is being presented from the audio output device 116. If the environment effect is not accounted for, the audio filtering module 404 may either overcorrect which can result in filtering out of some ambient noise or undercorrect which results in some of the unwanted audio being heard.

In example embodiments, the device filter signal is dependent on relative amplitude and spectrum of the arriving unwanted audio signal relative to the original unwanted audio signal that is the audio filter signal that is sent to the audio output device. The difference between these two signals is a result of the previously mentioned environmental effects such as reflections or absorptions, which themselves can be frequency dependent.

The device filter signal is output in operation 612 by the filtering output module 406. In embodiments where the audio filtering system 400 is embodied in the handheld device 118, the filtering output module 406 transmits the device filter signal to the audio device 122. Alternatively, in embodiments where the filtering output module 406 is embodied within the audio device 122, the filtering output module 406 provides the device filter signal to an audio output component (e.g., earphones) of the audio device 122 which presents the device filter signal to each ear of the user.

Figure 7:
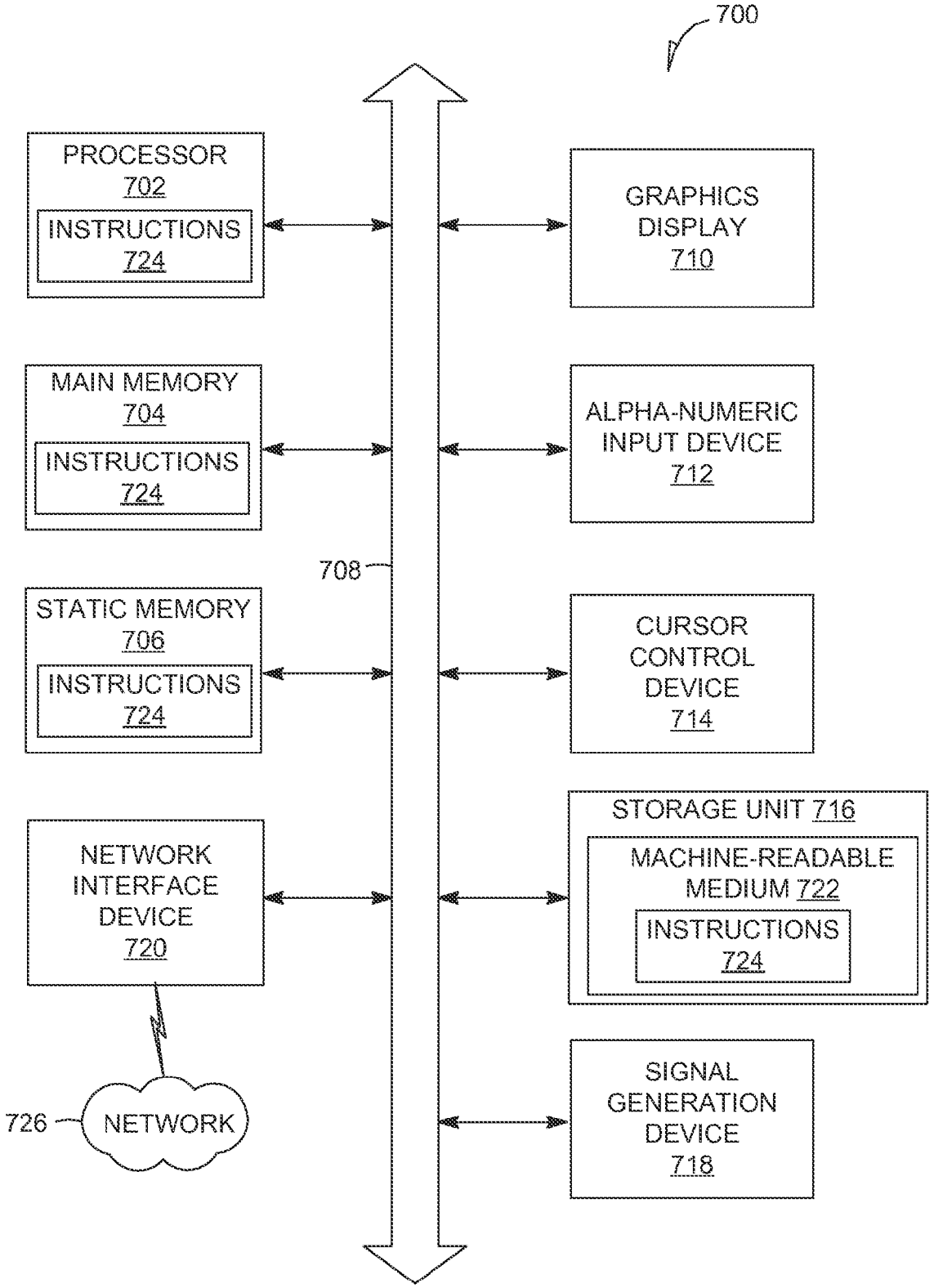
FIG. 7 is a simplified block diagram of a machine in an example form of a computing system within which a set of instructions for causing the machine to perform any one or more of the methodologies discussed herein may be executed.

FIG. 7 is a block diagram illustrating components of a machine 700, according to some example embodiments, able to read instructions 724 from a machine-readable medium 722 (e.g., a non-transitory machine-readable medium, a machine-readable storage medium, a computer-readable storage medium, or any suitable combination thereof) and perform any one or more of the methodologies discussed herein, in whole or in part. Specifically, FIG. 7 shows the machine 700 in the example form of a computer system (e.g., a computer) within which the instructions 724 (e.g., software, a program, an application, an applet, an app, or other executable code) for causing the machine 700 to perform any one or more of the methodologies discussed herein may be executed, in whole or in part.

In alternative embodiments, the machine 700 operates as a standalone device or may be connected (e.g., networked) to other machines. The machine 700 may be a server computer, a client computer, a personal computer (PC), a tablet computer, a laptop computer, a netbook, a set-top box (STB), a personal digital assistant (PDA), a cellular telephone, a smartphone, a web appliance, a network router, a network switch, a network bridge, or any machine capable of executing the instructions 724, sequentially or otherwise, that specify actions to be taken by that machine. Further, while only a single machine is illustrated, the term "machine" shall also be taken to include a collection of machines that individually or jointly execute the instructions 724 to perform any one or more of the methodologies discussed herein.

The machine 700 includes a processor 702 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 704, and a static memory 706, which are configured to communicate with each other via a bus 708. The processor 702 may contain microcircuits that are configurable, temporarily or permanently, by some or all of the instructions 724 such that the processor 702 is configurable to perform any one or more of the methodologies described herein, in whole or in part. For example, a set of one or more microcircuits of the processor 702 may be configurable to execute one or more modules (e.g., software modules) described herein.

The machine 700 may further include a graphics display 710 (e.g., a plasma display panel (PDP), a light emitting diode (LED) display, a liquid crystal display (LCD), a projector, a cathode ray tube (CRT), or any other display capable of displaying graphics or video). The machine 700 may also include an alphanumeric input device 712 (e.g., a keyboard or keypad), a cursor control device 714 (e.g., a mouse, a touchpad, a trackball, a joystick, a motion sensor, an eye tracking device, or other pointing instrument), a storage unit 716, a signal generation device 718 (e.g., a sound card, an amplifier, a speaker, a headphone jack, or any suitable combination thereof), and a network interface device 720.

The storage unit 716 includes the machine-readable medium 722 (e.g., a tangible machine-readable storage medium) on which are stored the instructions 724 embodying any one or more of the methodologies or functions described herein. The instructions 724 may also reside, completely or at least partially, within the main memory 704, within the processor 702 (e.g., within the processor's cache memory), or both, before or during execution thereof by the machine 700. Accordingly, the main memory 704 and the processor 702 may be considered machine-readable media 722 (e.g., tangible and non-transitory machine-readable media).

In some example embodiments, the machine 700 may be a portable computing device, such as a smart phone or tablet computer, and have one or more additional input components (e.g., sensors or gauges). Examples of such input components include an image input component (e.g., one or more cameras), an audio input component (e.g., a microphone), a direction input component (e.g., a compass), a location input component (e.g., a global positioning system (GPS) receiver), an orientation component (e.g., a gyroscope), a motion detection component (e.g., one or more accelerometers), an altitude detection component (e.g., an altimeter), and a gas detection component (e.g., a gas sensor). Inputs harvested by any one or more of these input components may be accessible and available for use by any of the modules described herein.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 722 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions for execution by a machine (e.g., machine 700), such that the instructions, when executed by one or more processors of the machine (e.g., processor 702), cause the machine to perform any one or more of the methodologies described herein. The term "machine-readable medium" shall accordingly be taken to include, but not be limited to, one or more data repositories in the form of a solid-state memory, an optical medium, a magnetic medium, or any suitable combination thereof.

Furthermore, the machine-readable medium 722 is non-transitory in that it does not embody a propagating or transitory signal. However, labeling the machine-readable medium 722 as "non-transitory" should not be construed to mean that the medium is incapable of movement—the medium should be considered as being transportable from one physical location to another. Additionally, since the machine-readable medium 722 is tangible, the medium may be considered to be a machine-readable device. Furthermore, the machine-readable medium does not comprise any transitory signals.

The instructions 724 may further be transmitted or received over a communications network 726 using a transmission medium via the network interface device 720 and utilizing any one of a number of well-known transfer protocols (e.g., HTTP). Examples of communication networks include a local area network (LAN), a wide area network (WAN), the Internet, mobile telephone networks, plain old telephone service (POTS) networks, and wireless data networks (e.g., WiFi, LTE, and WIMAX networks). The term "transmission medium" shall be taken to include any intangible medium that is capable of storing, encoding, or carrying instructions for execution by the machine, and includes digital or analog communications signals or other intangible medium to facilitate communication of such software.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some, embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field-programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules.

Some portions of the subject matter discussed herein may be presented in terms of algorithms or symbolic representations of operations on data stored as bits or binary digital signals within a machine memory (e.g., a computer memory). Such algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

Although an overview of the inventive subject matter has been described with reference to specific example embodiments, various modifications and changes may be made to these embodiments without departing from the broader spirit and scope of embodiments of the present invention. For example, various embodiments or features thereof may be mixed and matched or made optional by a person of ordinary skill in the art. Such embodiments of the inventive subject matter may be referred to herein, individually or collectively, by the term "invention" merely for convenience and without intending to voluntarily limit the scope of this application to any single invention or inventive concept if more than one is, in fact, disclosed.

The embodiments illustrated herein are believed to be described in sufficient detail to enable those skilled in the art, to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present invention. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present invention as represented by the appended claims. The specification and drawings are, accordingly, to be regarded in an illustrative rather than a restrictive sense.

What is claimed is:

1. A method comprising:

receiving, from a presentation system, an audio filtering signal, the audio filtering signal corresponding to an unwanted audio track to be filtered from an ambient audio signal that includes a combined audio stream generated by the presentation system and outputted from an audio output device of the presentation system, the presentation s stem generating the combined audio stream by combining the unwanted audio track with a wanted audio track;

generating, by a hardware processor, a device filtering signal based on the audio filtering signal corresponding to the unwanted audio track; and causing the device filtering signal to be output by an audio device of a first user, the device filtering signal being played through the audio device to filter out the unwanted audio track while allowing other audio data in the ambient audio signal including the wanted audio track to be heard.

2. The method of claim 1, wherein:

the other audio data in the ambient audio signal comprises environmental noise along with the wanted audio track from a first content for the first user, and the unwanted audio track comprises an audio track from a second content for a second user.

3. The method of claim 1, further comprising:

detecting at least one reference signal; and determining an effect of an audio environment on the at least one reference signal, wherein the device filtering signal is based in part on the effect.

4. The method of claim 3, wherein the generating the device filtering signal comprises:

using the audio filtering signal to generate an inverse sound wave of the unwanted audio track; and adjusting a level of the inverse sound wave based on the effect to generate the device filtering signal.

5. The method of claim 3, wherein:

the audio filtering signal is an inverse sound wave of the unwanted audio track; and the generating the device filtering signal comprises adjusting a level of the inverse sound wave based on the effect.

6. The method of claim 3, wherein:

the audio filtering signal comprises a waveform of the unwanted audio track and the at least one reference signal is the unwanted audio track in the audio filtering signal; and the determining further comprising comparing a level of the waveform from the audio filtering signal to a level of a waveform of the unwanted audio track detected in the ambient audio signal.

7. The method of claim 3, wherein the at least one reference signal is detected by a microphone associated with the audio device.

8. The method of claim 3, wherein the at least one reference signal comprises one of a fixed decibel signal, an inaudible pilot tone, a steady tone, or a pulse provided with the audio signal.

9. The method of claim 1, wherein the receiving, generating; and causing occur within the audio device, the audio device being a headset.

10. A system comprising:

one or more hardware processors; and a storage device storing instructions that, when executed by the one or more hardware processors, causes the one or more hardware processors to perform operations comprising:

receiving, from a presentation system, an audio filtering signal, the audio filtering signal indicating an unwanted audio track to be filtered from an ambient audio signal that includes a combined audio stream generated by the presentation system and outputted from an audio device of the presentation system the presentation system generating the combined audio stream by combining the unwanted audio track with a wanted audio track;

generating a device filtering signal based on the audio filtering signal corresponding to the unwanted audio track; and causing the device filtering signal to be output by an audio device of a first user, the device filtering signal being played through the audio device to filter out the unwanted audio track while allowing the wanted audio track from the ambient audio signal to be heard.

11. The system of claim 10, wherein the wanted audio track includes environmental noise.

12. The system of claim 10, wherein the wanted audio track comprises an audio track from a first content that the first user is experiencing and the unwanted audio track comprises an audio track from a second content that a second user is experiencing.

13. The system of claim 10, wherein the operations further comprise:

detecting a reference signal;

determining an effect of an audio environment on the reference signal;

generating the device filtering signal by using the audio filtering signal to generate an inverse sound wave of the unwanted audio track; and adjusting a level of the inverse sound wave based on the effect to generate the device filtering signal.

14. The system of claim 10, wherein the audio filtering signal is an inverse sound wave of the unwanted audio track, and the operations further comprise:

detecting a reference signal determining an effect of an audio environment on the reference signal; and generating the device filtering signal by adjusting a level of the inverse sound wave based on the effect to generate the device filtering signal.

15. The system of claim 10, further comprising a microphone to detect a reference signal, the operations further comprising determining an effect of an audio environment on the reference signal, the effect used to adjust a level of an inverse sound wave in generating the device filtering signal.

16. The system of claim 10, wherein the one or more hardware processors and the storage device are embodied within the audio device, the audio device being a headset.

17. A method comprising:

receiving, by a presentation system, at least one content stream that includes a first audio track;

generating, by the presentation system, a combined audio stream that includes a reference signal, the first audio track, and a further audio track, the reference signal being used to determine a location of a user relative to an audio output device of the presentation system outputting the combined audio stream;

causing presentation of the combined audio stream from the audio output device of the presentation system; and providing, by a hardware processor of the presentation system, an audio filtering signal, the audio filtering signal corresponding to the first audio track, the first audio track being an unwanted audio track to be filtered from an ambient audio signal that includes the combined audio stream, the audio filtering signal being used to generate a device filtering signal to filter out the unwanted audio track from the ambient audio signal.

18. The method of claim 17, wherein the providing the audio filter signal comprises providing waveform data indicating a waveform of the unwanted audio track, the unwanted audio track being audio data that is to be filtered out of an ambient audio signal that includes the combined audio stream and environmental noise.

19. The method of claim 17, wherein the further audio track comprises a blank audio track, the audio filtering signal causing the user to hear only environmental noise.

20. The method of claim 17, wherein the reference signal comprises a selection from the group consisting of an inaudible pilot tone, a steady tone, and a pulse.

* * * * *